United States Patent [19]

McFarlan

[11] 4,419,864

[45] Dec. 13, 1983

[54] AIR CONDITIONING SYSTEM AND METHOD

[76] Inventor: Alden I. McFarlan, 691 Dorian Rd., Westfield, N.J. 07090

[21] Appl. No.: 301,655

[22] Filed: Sep. 14, 1981

[51] Int. Cl.[3] ..... F25D 17/02

[52] U.S. Cl. ..... 62/98; 62/159

[58] Field of Search ..... 62/325, 412, 98, 99, 62/118, 159; 165/2

[56] References Cited

U.S. PATENT DOCUMENTS

| | | | |
|---|---|---|---|
| 2,797,068 | 6/1957 | McFarlan | 62/159 X |
| 3,738,899 | 6/1973 | McFarlan | 165/2 |
| 4,010,624 | 3/1977 | McFarlan | 62/159 |

*Primary Examiner*—Lloyd L. King

[57] ABSTRACT

An air conditioning system and method wherein a central pumping system circulates a heat-exchange liquid (which is water or a glycol solution or other solution called "water") through heating and cooling paths of a refrigeration system and then to and from air-treating units. The fans or blowers of the air-treating units are positioned upstream of the air cooling and heating coils so that the fan heat and pump heat are discharged through the fluid cooler system during cooling load operation, and all of that heat is available for delivery to the air treating units during heating-load operation. In the embodiments shown the air is discharged through the fluid cooler to carry away heat during cooling load operation. One embodiment includes a separate line for neutral water to each air treating unit. The neutral water is mixed with either the hot water or the cold water supplied to each air-treating unit for temperature control as distinguished from the standard three-pipe system wherein hot and cold water are mixed to provide temperature control. Another embodiment is a four pipe system having separate supply and return lines for both hot water and cold water.

20 Claims, 2 Drawing Figures

AIR CONDITIONING SYSTEM AND METHOD

Figure 1:
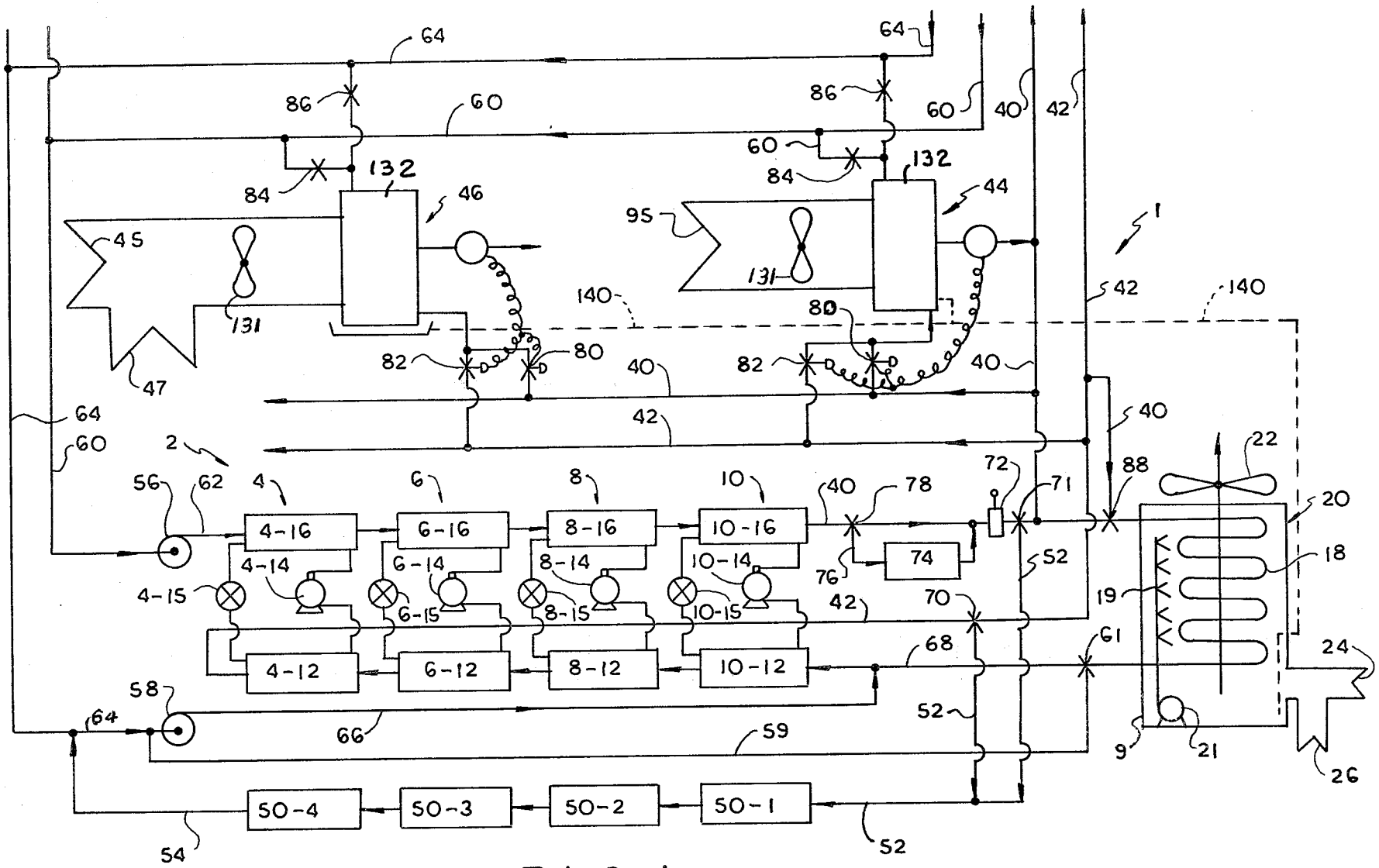

This invention relates to improved air-conditioning systems in which separate streams of water or other heat-exhange liquid are pumped to air-treating units for the various air conditioned spaces. Systems of that type are disclosed in U.S. Pat. Nos. 3,850,007 and 4,010,624 which will be discussed below.

The present invention provides for greatly improved efficiencies of air conditioning systems with wider ranges of operation. Systems of the present invention have fluid coolers which provide "heat-sinks" through which the heat removed from the air conditioned space is discharged from the system to ambient air or water. When ambient air is the "heat-sink" fluid for prior air conditioning systems it is common practice to spray water on heat exchange coils to produce evaporative cooling. The present invention utilizes the fluid cooler to perform its "heat-sink" functions in an improved manner, and the fluid cooler also performs additional functions, including acting as a means of heat removed when that is required by the system, rather than passing the heat through a fluid cooler. Heat is transferred throughout the system and to and from a fluid cooler by a heat-exchange liquid which is called "water", but which may be pure water or a glycol solution or another liquid.

The above-mentioned U.S. Pat. Nos. 3,850,007 and 4,010,624, disclose air conditioning systems having a plurality of fluid coolers, i.e., cooling towers for cooling condenser water or tower condensers. In each of those systems, one tower provides cooling by air without evaporation of water, and another tower utilizes the condensate from the air conditioning system as the water which is evaporated to provide evaporative cooling. It is considered good practice from an engineering standpoint to provide outside air in air conditioning systems upon the basis of at least 1/10 cubic foot of air per minute for each square foot of area being cooled, and the remainder of the air is recirculated. With a view of conserving energy, it is also considered necessary to maintain the amount of outside air at the lowest level which will provide acceptable conditions within the air conditioned space. That has resulted in maintaining the various operating conditions of air conditioning systems within certain predetermined ranges. The systems disclosed in the above-identified patents operate generally within the accepted ranges of the various conditions, but can operate with more outside air than is used than with present invention so as to reduce the overall energy consumption. Each of those systems utilizes the condensate from the air conditioning system to cool at least one of the fluid coolers, i.e., a cooling tower or an envaporative condenser. Streams of heat-exchange liquid, such as water, flow through continuous circuits some of which carry the heat from the air-treating units which dehumidify and cool the air, to the evaporator-chillers of the refrigeration units, and another of which carries the heat from the condensers of the refrigeration units to the fluid coolers. A stream of heat-exchange liquid flows through the evaporator-chillers of a series of refrigeration units with its temperature being reduced in steps by the various evaporator-chillers. The flow through the condensers to the respective refrigeration units is counter to the flow through the evaporator-chillers of the respective refrigeration units.

The specific illustrative embodiments of the present invention are systems similar to those disclosed in the above-identified patents. However, in those embodiments, one fluid cooler is provided, and all of the condensate and the exhaust air available from the system are used to provide evaporative cooling for that fluid cooler. When the system is cooling the air conditioned space, the temperature of the water or other heat-exchange liquid passed to the fluid cooler is at a higher temperature than in the systems of the above-identified patents, and at a much higher temperature than the normally accepted practice. Also, the temperature drop of the heat exchange fluid is much greater than is normally provided in the fluid coolers or cooling towers of such air conditioning systems.

The present invention contemplates supplying outside air to the air-treating units in an amount relative to the total amount of air supplied to the air conditioned space which is within the range of 100% outside air to 1/10 cubic foot per minute per square foot of air conditioned space, with recirculated air being added only as the remainder when desirable. It is accepted practice to maintain the air pressure within an air conditioned space at a value slightly above the outside air pressure so that there is leakage from the air conditioned space and air is exhausted automatically from toilets, kitchens, chemical laboratories, etc. Otherwise, the amount of exhaust air is the same as the amount of outside air which is added to the system. In accordance with one aspect of the present invention, the amount of exhaust air which passes through the fluid cooler must be sufficient to discharge the amount of heat required to provide proper operation of the system. That is contrary to the generally accepted practice by which it has been considered desirable to use a much lower percentage of outside air than is utilized with the present invention, without penalizing energy consumption.

Figure 2:
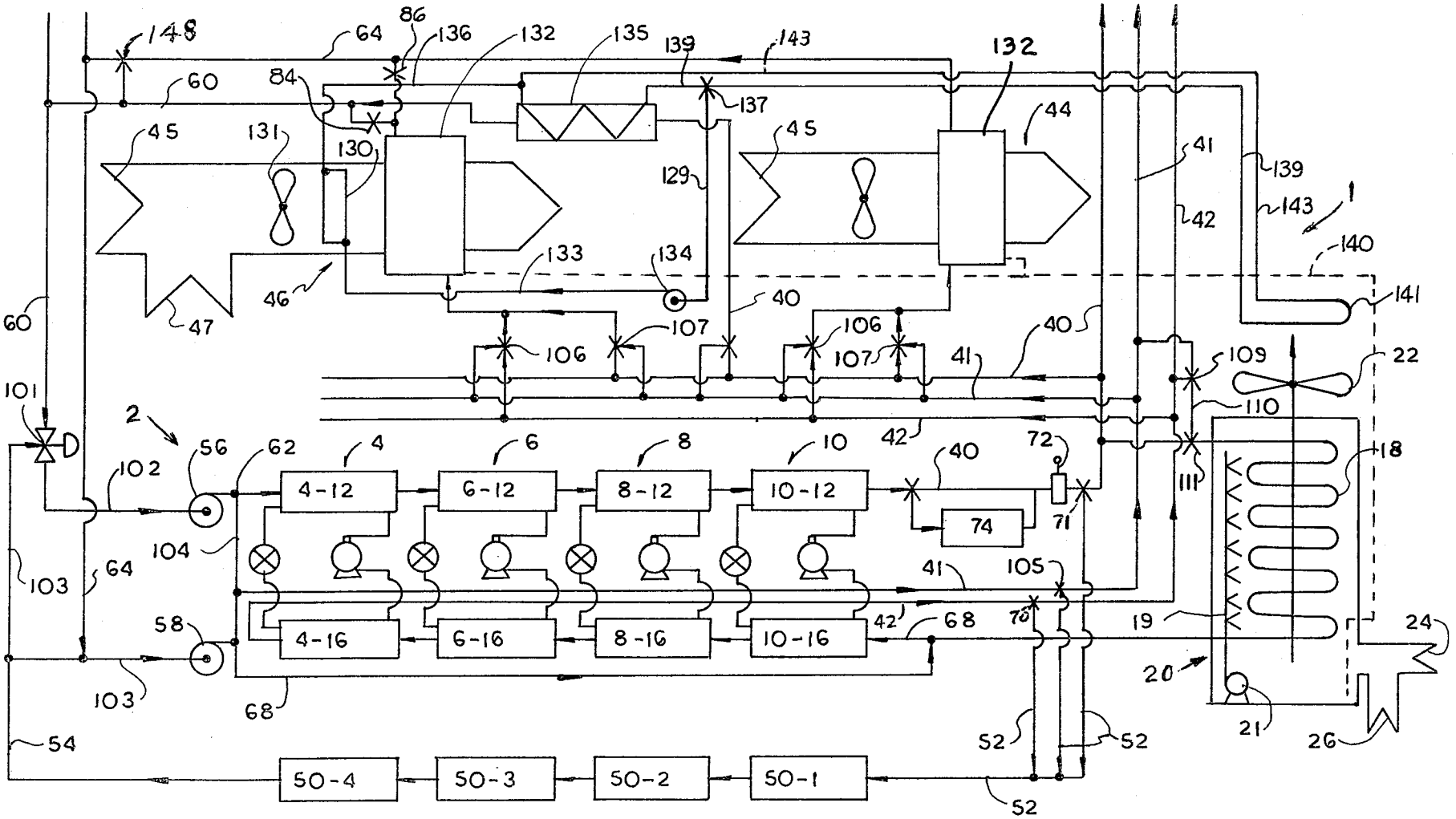

Referring to the drawings:

FIG. 1 is a schematic representation of a four-pipe air conditioning system which comprises one illustrative embodiment of the invention: and, FIG. 2 is similar to FIG. 1 but is of a three-pipe embodiment of the invention.

Referring to FIG. 1 of the drawings, an air-conditioning system 1 has a central refrigeration system 2 with four refrigeration units 4, 6, 8 and 10. Each of the refrigeration units has the following identical components of known types which are identified by the component number with a suffix number corresponding to the number of the refrigeration unit: A water-cooling evaporator-chiller or water cooler 12; a compressor 14; a water-cooled condenser 16; and, an expansion valve 15. There are also other standard control and operating components which are not shown. The water cooling circuits of the evaporator-chillers are connected in series flow to form the water-cooling circuit. The water heating circuits of the condensers are connected in series flow to form the water-heating circuit.

The system has a single fluid cooler 20 with the following components: A finned air-to-water heat exchange coil 18; a sump pan 17; a sprayer means 19 with a pump 21 which circulates water from pan 17 over coil 18; a blower 22 which forces air upwardly through the coil; and, an air supply damper assembly which supplies air to the fluid cooler with air being exhausted from the air conditioned space at 24 and ambient (outside) air being supplied at 26 in the manner more fully explained below.

Air conditioning system 1 has an air treating unit 44 which is one of a number of similarly functioning units which supply conditioned air to the periphery of the building, and an air treating unit 46 which is one of a number of similarly functioning units which supply air to the interior of the building. Hot and cold water is supplied to the air treating units, respectively through separate hot water supply line 40 and its branches and cold water supply line 42 and its branches, and each unit is connected to separate hot water and cold water return lines 60 and 64, respectively. Each of air treating units 46 is supplied with a stream of return air at 45 and a predetermined percentage of outside air at 47. The system has four water retention or storage tanks 50 which are connected and numbered 1 to 4 in a tank series flow circuit between a supply line 52 and a discharge line 54, which is connected directly to both the cold water line 42 and the hot water line 40. As will be discussed below, either hot water or cold water, is supplied to the tanks depending upon the operating conditions.

Two pumps 56 and 58 constitute the water-pumping means which circulates the water throughout the entire air conditioning system. Pump 56 receives water through a hot water return line 60 the branches of which extend from each of the air treating units 44 and 46. Pump 56 discharges the water through a line 62 which leads only to the water-heating circuit of the condensers in series and thence to the hot water line 40. Pump 58 is also connected to receive water from all of the air treating units through a cold water return line 64 and its branches, and it can also receive water from the series flow circuit of tanks 50 through a line 54. Pump 58 discharges water through a line 66 which is connected to line 68 which extends from coil 18 of the fluid cooler to the water cooling circuit of the evaporator-chillers. Under most conditions of operation, the water flows from line 68 through the water-cooling circuit of the evaporator-chillers to the cold water line 42. It should be noted that the flow through the respective condensers is counter to the flow through the evaporator-chillers, of the respective refrigeration units. This provides substantial advantages from the combination of the staged cooling by the water-cooling circuit and the counterflow staged heating of the water flowing along the water-heating circuit.

Two valves 70 and 71, which are normally closed, may be opened to connect the cold water line 42 or the hot water line 40 to line 52 so as to permit either cold or hot water to be delivered to the series flow circuit of tanks 50. That provides great flexibility in operating, for example, to permit the recirculation of water from and back to tanks 50 to extract heat from the water in the tanks during off-peak cooling-load conditions at night and thereby provide a "flywheel" effect to assist in handling an excessive cooling load during the daytime. A boiler 74 is connected in a line 76 which extends parallel to line 40, and a control valve 78 is operated to divert water through the boiler when auxiliary heat is required. A heat-balance controller 72 senses the temperature of the water in line 42 downstream of the boiler circuit and controls valve 78. However, the facility for recirculating water from the tanks through the water chillers and back to the tanks is of substantial benefit under extreme heating load conditions because it is possible to remove heat from the water in the tanks and thereby increase the heating capacity of the system rather than utilizing the boiler. Heat balance controller 72 also exerts overall control over the entire air conditioning system and responds to the temperatures and heating and cooling load conditions throughout the air conditioned space and to the outside air temperature. Except as specified and discussed below, the control circuit, including the sensing and control components and the modes of operation, are in accordance with the prior U.S. Pat. No. 3,738,899.

Each of air treating units 44 and 46 is connected to hot and cold water supply lines 40 and 42 respectively by valves 80 and 82 which are thermostatically controlled in response to the temperature of the air discharged by the unit. Each of units 44 and 46 is thereby connected to receive either hot or cold water, but not a mixture of the two, to maintain the desired air temperature in the conditioned spaces. Valves 84 and 86 connect each of units 44 and 46 to the hot and cold water return lines 60 and 64, respectively. Valves 80 and 84 for each unit 44 and 46 are opened and closed together, and valves 82 and 86 are opened and closed together, so that the hot water from line 40 is returned to pump 56 and the cold water from line 42 is returned to pump 58. A modulating valve 88 connects both the hot water line 40 and the cold water line 42 to coil 18 of the fluid cooler. Modulating valve 88 is normally in the position in which it supplies only hot water to coil 18 of the fluid cooler. However, there are times when valve 88 supplies cold water to coil 18, for example, when the fluid cooler is being used as a source of heat with a heat pump action extracting heat from the exhaust air. The outside air dampers can then be closed so that only exhaust air passes through the fluid cooler, and cold water is supplied to coil 18. Valve 61 is then positioned to pass the water from coil 18 through line 59 to pump 58 and through the water-cooling circuit. Water returning through line 64 also passes from pump 58 through the evaporator-chiller circuit, and additional water may be also recirculated through the tank circuit. That operation raises the temperature level of the hot water so that the heat extracted from the air in the fluid cooler and the internally-produced heat which is recovered through units 46 and stored in hot water in tanks 50 is utilized to handle the heating load.

While pumps 56 and 58 are not connected in parallel, the flow circuits are interconnected so that the water flows in many different paths. The system of FIG. 1 operates completely under the automatic control of heat balance controller 72 which operates the valves and other components in response to changes in the heating and cooling load conditions of the various air conditioned spaces and the ambient air temperature, and in accordance with a daily time program.

The following are illustrative modes of operation of the system of FIG. 1:

1. Various embodiments of the present invention incorporate certain concepts of U.S. Pat. No. 3,738,899 and involving the utilization of water storage tanks. The water acts as (a) a heat source under high heat load conditions, and (b) as a source of supplementary stored chilled water under high cooling-load conditions. The tanks contribute substantially to the high efficiency of the illustrative systems for the standpoint of conservation of energy. The tanks also broaden the scopes of the heating and cooling loads which the illustrative system can handle.

2. For peak cooling load conditions without use of the tanks, the return water from line 64 is added to the cooled water from the fluid cooler in line 68, and the hot water from the condenser circuit flows to the fluid cooler.

3. For Summer night operation particularly when high cooling load conditions are anticipated on the following day, the water in tanks 50 is cooled by recirculating it through the evaporator-chillers and through line 52, back to the tanks and hot water passes from line 40 through the fluid cooler. During night operation the condenser heat is dissipated through the fluid cooler using outside air. The stored chilled water then aids in handling the cooling load during the following day.

4. For peak heating load conditions without the use of the tanks, the chilled water flows from line 42 through valve 88 to the fluid cooler in which the water is heated by the exhaust air and it returns through line 68 to the evaporator circuit. The chilled water which has been heated and then returned is cooled again in the evaporator-chiller circuit so as to add heat to the sytem, and the heat is delivered to the water in the condenser circuit which flows through line 40 to the air treating units, as the return water passes to the condenser circuit.

5. For a system using 100% outside air for example at peak heating loads, some chilled water is passed through line 42 and valve 88 to coil 18 of the fluid cooler and then through valve 61 and line 59 to pump 58 and through the evaporator-chillers. The remainder of the chilled water is recirculated through tanks 50 to reduce the composite temperature of the water in the tanks and thereby false load the evaporator-chillers with warm stored tank water. That raises the temperature level of the hot water which flows through the condenser circuit to the air treating units and back to pump 56.

6. For heating below the break-even temperature (which is the outside air temperature at which the overall heat loss from the system is equal to the heat produced within the system), heat is extracted from the exhaust air by the fluid cooler. For that operation, chilled water flows through line 42 and valve 88 to the fluid cooler, and from valve 61 through line 59 back through the evaporator-chillers. The heat recovered in the fluid is delivered by the condensers to the hot water.

7. During a Winter building "shut down" period, the water in tanks 50 can be used as a heat source by recirculating water from the tanks.

The system of FIG. 2 is similar to that of FIG. 1, but there is a third liquid distribution line 41 for neutral water which is at a temperature between those of the hot and cold water. Line 41 extends to the valves supplying water to the various air treating units and is connected elsewhere as shown in the drawings. The components of the system of FIG. 2 which are identical with those of FIG. 1 are given the same reference numbers. Return line 60 is connected through a valve 148 to line 64 and through a valve 101 and a line 102 to pump 56, and from valve 101 through a line 103 to pump 58. Hence, the return water from any of units 44 and 45 can be delivered to either of the pumps. A line 104 is connected to the outlet sides of both of the pumps and also to neutral line 41 so that line 41 can receive water from either of the pumps. Line 103 is also connected to the discharge line 54 from the storage tank circuit, and neutral line 41 is connected through a valve 105 to supply line 52 to the tank circuit, so that the tank circuit can receive hot water or cold water or neutral water, but discharges only through pump 58. However, water from either pump can be discharged through the evaporator-chiller to line 42, or to neutral line 41, or through the condenser circuit to hot water line 40. However, the "preferential flow pattern" is from pump 58 through the chiller circuit to line 42, and from pump 56 through the condenser circuit to line 40, and secondly only from each pump to neutral line 41. The flow patterns from the pumps result directly from the flow through the various air treating units 44 and 46. That is, when greater amounts of either hot or cold water are used, there is a drop in the back pressure in the respective line 40 or 42, and less water flows from the respective pump to another path. At each of the air treating units there are two variable mixing valves, valve 106 which is operative to supply controlled amounts of cold water and neutral water to the unit, and valve 107 which is operative to supply controlled amounts of hot water and neutral water to the unit. Hence, each unit is supplied with either hot water or cold water alone, or a mixture of one of those with the neutral water, to thereby control the temperature of the air being discharged from the unit.

A modulating valve 109 connects neutral water line 41 and cold water line 42 to a line 110 which is connected through a modulating valve 111 to coil 18 of the fluid cooler, so that either cold water or neutral water or a mixture of the two can be supplied to coil 18. Valve 111 is also connected to hot water line 40 so that hot water or a mixture of hot water and neutral water from line 110 can be supplied to coil 18. However, the invention does not contemplate mixing hot and cold water at valve 111, and neutral water would be supplied to line 110 if any water were to be moxed with the hot water by valve 111.

The system of FIG. 2 is also provided with an air-preheater system for air-treating units 46. A glycol solution or other antifreeze liquid to air heat-exchange coil 130 is positioned between fan 131 and the heat-exchange coil 132 so as to pre-heat the air flowing into coil 132. A glycol solution is supplied to coil 130 from a pump 134, through a line 129 to pump 134. Heat-exchanger 135 receives hot water from line 40 which is discharged to line 60 after passing the hot water in heat-exchange relationship with the stream of glycol solution.

An additional means for heating the glycol solution is provided by a coil 141 in the fluid cooler positioned in the path of the exhaust air. The exhaust air will have given up a substantial amount of heat in passing through coil 18, but normally will be at a temperature substantially above that of the outside air being supplied to units 46. A pair of lines 143 and 139 extend from coil 141 respectively to line 136 and to a valve 137 in line 129. Valve 137 is operative to divert all or part of the stream of glycol flowing to pump 134 from heat-exchanger 135 to line 139 so that glycol heated in coil 141 is delivered to pump 134 and flows through line 133 to coil 130. When sub-freezing temperature air is being supplied to units 46, the glycol solution will be at a sufficiently high temperature to pre-heat the air entering units 46.

The following are illustrative modes of operation of the system of FIG. 2:

1. At peak cooling during the daytime with 20% outside air, for example, and without use of the water in the storage tanks, the chilled water temperature is reduced from 72° F. to 40° F., and the temperature of the hot water is increased from 77° F. to 115° F. The water flowing through the fluid cooler is cooled from 115° F. to 72° F. The outside air enters at 95° F., and air is delivered to the air-conditioned spaces at 55° F., and returns to units 46 at 78° F.

2. At peak cooling during daytime with 100% outside air, and with the water in tanks 50 having been precooled during the night, all of the hot water passes to the fluid cooler and then flows with some water from tank 50 to the evaporator-chiller circuit. The amount of water from tanks is that required to satisfy pump 58 (when added to the water from the fluid cooler), and the same amount flows from neutral line 40 to the tanks. Illustratively, chilled water flows from tanks 50 at 40° or higher and is mixed with return water and flows through neutral line 41 or through the chiller and line 40 to units 44 and 46.

3. The water in tanks 50 may be used to supply supplement heat, and heat can be recovered by cooling the exhaust air. For that operation, pump 58 receives hot stored water from tanks 50 and return water from the air treating units through lines 60 and 64, and the chilled water flows to the fluid cooler which is supplied with exhaust air only. Pump 56 directs air through the condenser circuit. The neutral water can flow from either of the pumps.

In each of FIGS. 1 and 2, the entire water circulating system provides continuous flow from the two pumps. In FIG. 2, the flow is through the hot, cold and neutral water lines to the various air treating units, whereas, in FIG. 1, there are various hot water and cold water circuits which are separate. The paths of flow are created by controller 72 which controls the temperature of the hot water and the quantity and temperarture of the water flowing to the fluid cooler, thereby to deliver heat to or carry heat from the air treating units, and to carry heat to and from the fluid cooler and the tank circuit. With a cooling load, with the water passing through coils 132 counterflow to the air, the air picks up the fan heat and transfers it to the water leaving the coil without materially reducing the air-cooling effect of the coils. The water passes to pump 56 and also picks up the pump heat, and flows to the condenser circuit, and all of the fan and pump heat is carried to fluid cooler 20. With a heating load the fan heat gives an air-preheating effect, and the pump heat is added to the hot water. Hence, the fan and pump heat is carried to the fluid cooler at outside temperatures above the break-even temperature, and to the air treating units at outside air temperatures below the break-even temperature. The illustrative systems include a "fluid cooler", which is illustratively an evaporative cooling tower, but it may be a well-water heat-exchanger wherein the well-water is the heat-sink and heat source instead of the ambient air. However, in either type of fluid cooler, the fluid, either air or well-water, being discharged from the system is a potential heat source below the break-even temperature, and is a potential heat-sink above the break-even temperature.

In the illustrative embodiments, the fluid cooler is a cooling tower which utilizes the condensate and the exhaust air to provide the heat-sink means, and which utilizes the exhaust air as a heat source during operation below the break-even temperature. It is understood that a stream of water from a well or another source can be the heat-sink and a heat source, with a liquid-to-liquid heat-exchanger being the "fluid cooler".

In the illustrative embodiments of the present invention condensate from coils 132 of the air treating units 44 and 46 is delivered to the fluid cooler and is used for evaporative cooling of coil 18. An illustrative gravity-feed system for accomplishing that function is represented by the dotted lines 140 in each of FIGS. 1 and 2.

This invention contemplates the necessary use of a minimum amount of outside air with substantially the same amount being exhausted through the fluid cooler and thereby raising the wet bulb temperature of the exhaust air to a level higher than is the usual practice. That is made possible by the higher temperature condensing water leaving the staged condenser circuit before entering the fluid cooler, thus allowing the available quantity of exhaust air to pick up much more heat than in the systems of the previous patents mentioned above.

Where the system requires more outside air than required for normal human-comfort applications, such as hospitals, laboratories, restaurants, etc., advantage can be taken of the greater resulting amount of exhaust air to thereby reduce the number of stages in the staged water cooler system. That is because the greater quantity of exhaust air available will permit the dissapation of the generated condenser heat with a lower wet bulb temperature leaving the fluid cooler.

The minimum quantity of dehumidified outside air to satisfy the exhaust air requirement for the fluid cooler will be about 0.11 cubic foot per minute per square foot of air conditioned space. However, the use of greater quantities of outside air, when available, and even when not necessary for adequate ventilation requirements, can sometimes be justified to reduce the overall consumption of compressor energy. That is true particularly when greater quantities of outside air are provided at outside wet bulb temperatures below peak design conditions.

In many cases the condensate may be more than enough to supply the make up water for the fluid cooler especially when 0.2 cubic feet per minute of outside air per square foot of conditioned space is introduced through air treating units 46. When additional water is required to maintain a satisfactory level in the fluid cooler pan, an automatic inlet valve controlled by a float in the pan will admit additional water.

A drain valve in the pan set at a higher level in the pan will permit water to overflow when excess water is supplied. By increasing those two levels, excess condensate water can be accumulated to handle the evaporative cooling when the water in storage tanks 50 is being cooled and there is no air cooling so that no condensate is being generated.

In FIGS. 1 and 2, the condensate flows by gravity to the fluid cooler. When the fluid cooler is at a level above that of the air treating units, the condensate is collected in a sump tank, and is pumped to the fluid cooler. A float control in the fluid cooler sump pan starts with there being a float control to start the pump at a maximum condensate level in the sump tank and stops it at a minimum level.

The systems of FIGS. 1 and 2 have fresh water supply means (not shown) which are operative to add water to the fluid cooler when the water level in the sump is below an acceptable level. However, it is contemplated that the condensate will be sufficient in many installations to make it unnecessary to add additional water except under emergency conditions. A drain valve (not shown) in the sump permits condensate to overflow when the amount of condensate is greater than that evaporated in the fluid cooler.

While removing condenser heat, the water leaving the fluid cooler approaches the wet-bulb temperature of the entering air. A practical design is to provide a difference between those temperatures of the order of ten degrees F. so that 62° room air-exhaust temperature will produce 72° return water leaving the fluid cooler. For example, at peak cooling load conditions of 95° outside temperature, the return water from the air-treating units, after picking up the fan heat from the fan located ahead of the unit coils as shown in FIG. 1, will be between 74° and 84° depending upon the percentage of outside air used. The fan heat will raise the return water temperature from two to four degrees F. Normally, the refrigeration load required would be in relation to the temperature of the water entering the first water cooler (evaporator-chiller) minus the temperature of the water leaving the last water cooler, for example 74° to 84° entering (depending upon the percent of outside air) and the leaving temperature, for example, 40°. By comparison, with the water leaving the fluid cooler at 72°, the refrigeration load is reduced in the ratio of $$\frac{72-40}{74-40} \text{ to } \frac{72-40}{84-40}$$

depending upon the percent of outside air used.

In effect, this invention permits the use of the heat pump principle to raise the temperature of the hot water from the condenser circuit by staging the flow of the water through the evaporator-chillers counter to the flow through the condensers of the respective refrigeration units. It is noted this higher condensing water temperature is obtained without increasing the compressor horsepower as would be the case for equal condensing water temperatures using single stage compressor systems.

It is also noted that the greater quantities of outside air are possible without the penalty of higher operating expense as would be the case with present conventional systems. This is particularly important in multi-story office buildings. Stack effect with low volume of outside air such as 0.1 cubic foot of air per minute per square foot of air conditioned space can cause infiltration of outside air through doors and at the lower level floors at low outside air temperatures. Severe heating problems have occurred at low outside air temperatures and the higher hot water temperatures made possible by the present invention overcome those problems. It is also noted that heat is recovered from the increased quantity of outside air.

The provision of a neutral water line in the system of FIG. 2 gives very substantial advantages over the now conventional "three pipe" systems of U.S. Pat. No. 2,796,740 where hot and cold water lines and a return line extend to each air treating unit. With those systems, hot and cold water are available at each such unit and are mixed when necessary to provide water of the desired temperature for the unit while maintaining a uniform rate of water flow through the units. That was a very substantial improvement over the prior four pipe systems. However, the use of neutral water to mix with either hot or cold water gives greatly improved utilization of energy. The neutral water is subjected to no heating or cooling and the only energy consumed is that required to circulate it, and it provides precise control of the air temperature.

The respective terms "fan heat" and "pump heat" means the heat produced within the system by the operation of the fans or blowers and by the water pumps. The total of all of that heat in any central air conditioning system for a large building is not less than five percent of the total cooling load for the entire system, and may be several times that percentage. The present invention provides for transferring all of the fan heat to the water at the downstream sides of the air-treating units so that that heat is carried back to the refrigeration system by the return water without materially affecting the cooling of the air streams. The pump heat is also transferred to the return water before the water passes to the refrigeration system. Hence, all of that heat is discharged in an efficient manner through the fluid cooler under cooling-load conditions, and it is available below the breakeven outside temperature to aid in handling the heating load. The system can also recover heat from the exhaust air and from outside air when energy conservation considerations make that desirable.

The fluid cooler of the illustrative embodiments is an evaporative cooling tower. When the fluid cooler is a stream of outside water from a well or another source, the invention contemplates the use of a tower in which exhaust air is passed in heat-exchange relationship with a stream of the hot water or cold water of the system, in accordance with modes of operation discussed above.

It should be noted that the single heat transfer coils of air-treating units 44 and 46 are used for both heating and cooling. That is particularly advantageous with "four pipe" systems such as in the embodiments of FIG. 1. That provides for efficient heat transfer at all times so that the desired wide ranges of temperature changes can be insured.

It is understood that modifications can be made in the illustrative embodiments of the invention and that the various aspects thereof can be used separately or together all within the scope of the claims. Each system must be designed and engineered to meet the particular requirements for the system to provide efficient operation at an acceptable initial cost. To that end, the various concepts of the present invention provide choices in the basic design features so as to provide energy-efficient systems which meet a wide range of different basic requirements.

I claim:

1. In a method of air-conditioning a space, the steps of forming a stream of circulating air from a controlled volume of outside air and which may include a controlled volume of recirculated air from said space, passing said stream of circulating air through air-treating means and thereby cooling said stream of circulated air with a refrigeration system which has a fluid cooler in which heat is discharged from said system by a heat-exchange relationship with a stream of exhaust air which is discharged from said space, the volume of said stream of exhaust air being variable with said volume of outside air, and controlling said volume of outside air in said stream of circulating air passing through said air-treating means to that amount required to discharge heat through said fluid cooler at a sufficient rate to maintain the operating conditions within acceptable limits.

2. A method of operating an air conditioning system which includes a plurality of separate refrigeration units wherein each of said units includes, an evaporator-chiller in which a stream of a heat-exchange liquid is cooled by the evaporation of refrigerant, a condenser in which a stream of said heat-exchange liquid is heated by the condensation of refrigerant, a fluid cooler in which a stream of said heat-exchange liquid is cooled by the circulation of a stream of air and the simultaneous evaporation of water, air-treating means in which air is passed in heat-exchange relationship with a stream of said heat-exchange liquid to cool the air and when desirable to dehumidify the air and thereby produce condensate, means providing a continuous flow of air to and through said air-treating means and to deliver conditioned air from said treating means to a space and to discharge exhaust air from said space, and liquid-flow circuit means providing a continuous first flow path for a first stream of said heat-exchange liquid through said condensers in a predetermined series-flow circuit whereby heat is transferred to said first stream of heat-exchange liquid from each of said refrigeration units to provide a stepped increase in the temperature of said first stream of heat-exchange liquid, said liquid-flow circuit means also providing a continuous second flow path for a second stream of said heat-exchange liquid through said evaporator-chillers in a predetermined order which is the reverse order with respect to said flow through said condensers of the respective refrigeration units whereby said second stream of heat-exchange liquid is cooled through its first and last steps by the evaporator-chillers which are the respective components of the same refrigeration units as the respective last and first condensers through which said first stream of heat-exchange liquid flows, said flow circuit means also including interconnecting means providing a continuous flow circuit for said heat-exchange liquid through said fluid cooler and selectively from said first and second stream of heat-exchange liquid; the improvement which comprises delivering said exhaust air to said fluid cooler as said streams of air and delivering said condensate to said fluid cooler as said water, and supplying a sufficient quantity of outside air to said air-treating means to provide exhaust air to discharge heat through said fluid cooler at a sufficient rate to maintain the operating conditions within acceptable limits.

3. The method described in claim 2 which includes supplying recirculated air and outside air to said air treating means in controlled relative volumes whereby the outside air constitutes an amount within a range of the order of 10% to 100% of the conditioned air and wherein the temperature of the conditioned air is within a range of the order of 65° F. to 78° F. and its humidity is within a range of the order of 40% to 50%.

4. The method as described in either of claims 2 or 3, wherein said first stream and said second stream of heat exchange liquid comprise the same stream which passes from said air-treating means to pumping means and thence when cooling is desired passes along said first flow path and back to said air-treating means, and when additional heating is desired below the breakeven temperature, passes said stream of heat-exchange liquid along said second flow path and thence through said fluid cooler and along said first flow path, whereby heat is added from exhaust air to said heat-exchange liquid in said fluid cooler.

5. In air conditioning system for a space, the combination of, refrigeration means at a central station which is operative to produce a stream of heated water and a stream of chilled water, water-circulating means for said streams of water which comprises pumping means and water-flow lines and valve means which control the paths of flow of said streams of water, air-treating means to which said streams of water are delivered and are returned to said central station through said water-flow lines, fluid heat-exchange means which is operative to pass a stream of said water in heat-exchange relationship with a fluid which acts as a heat-sink to discharge heat from the system, said water-flow lines including separate water-distribution lines for both of said heated water and said chilled water and also for neutral water which is at a temperature between the temperatures of said heated water and said chilled water, said valve means including mixing-value means which is adapted to mix a stream of said neutral water with a stream of either said heated water or said chilled water and to deliver the mixture to said air treating means, and control means which operates said valve means to control the temperature of the water supplied to said air-treating means to maintain the desired temperature conditions in said space.

6. The system as described in claim 5, wherein said air-treating means comprises a plurality of air-treating units and said pump means comprises two separate pumps, and wherein said water-flow lines includes two separate water-flow lines extending from each of said air-treating units to the respective of same pumps.

7. The system as described in either of claims 5 or 6 which includes water-storage means which contains stored water and to which water is delivered which is at a temperature which is different from that of said stored water to thereby change the temperature of the stored water, whereby said stored water acts as a heat-sink or a heat source.

8. In an air conditioned system for a conditioned space, the combination of, refrigeration means which provides a water-cooling circuit to produce cold water and a water-heating circuit to produce hot water, air-treating means which is operative to condition air for said space to satisfy particular conditions of operation, a water distribution system which supplies water to said air-treating means and comprising three separate lines, one of which carries neutral temperature water and the others of which carry hot water and cold water at temperatures respectively above and below the temperatures of said neutral water, water-storage means connected to receive and store water from any of said lines, pump means comprising two separately-operable pumps one of which directs a stream of water along said water-cooling circuit through said refrigeration means and the other of which directs a stream of water along a water-heating path through said refrigeration means water lines connected to receive water from said air treating means and to deliver it to said pumps, a water-flow line extending between the inlet side of said pump means to deliver water to said distribution line for said neutral water, fluid-cooler means which is operatively connected to discharge heat from the system by passing a heat-transfer stream of said water into heat-exchange relationship with a fluid which acts as a heat-sink, and control means which is responsive to the temperature conditions within the conditioned space and which is operative to control the supply of water from the respective said distribution lines to said air treating units and to said heat-transfer stream.

9. The construction as described in claim 8 which includes means to produce said heat-transfer stream from either said cold water or said neutral water, or a mixture of the two.

10. The construction as described in either of claims 8 or 9 wherein said fluid which acts as a heat-sink also acts as a heat source at outside air temperatures below the heat balance temperature.

11. The construction described in either of claims 8 or 9 wherein said fluid which acts as a heat-sink includes air exhausted from said conditioned space.

12. In an air conditioned system, for a conditioned space, the combination of, refrigeration means which provides a water-cooling circuit for cold water and a water-heating circuit for hot water, air treating means which is operative to condition air to satisfy conditions of operation, and a water distribution system having three separate lines respectively for said hot water and cold water and neutral water at a temperature between those of said hot water and said cold water, pump means which directs a stream of water along a water-cooling path through said refrigeration means and a stream of water along a water-heating path through said refrigeration means, fluid cooler means which is operative to discharge heat from the system and control means which is operative to provide the desired temperature conditions within the conditioned space by controlling the supply of either hot water or cold water, or a mixture of one of those and said neutral water to said air-treating means.

13. In an air-conditioning system, the combination of, a first refrigeration unit, a second refrigeration unit, each of said refrigeration units having a liquid cooled condenser and an evaporator-chiller which is adapted to cool a liquid, a plurality of pumps one of which is operatively connected to direct a first stream of cooling liquid through said condenser of said first refrigeration unit and thence through said condenser of said second refrigeration unit whereby said liquid is heated by stages, said pumps including a pump which is operatively connected to direct a second stream of liquid to be chilled by said evaporator-chiller of said second refrigeration unit and thence by said evaporator-chiller of said first refrigeration unit whereby the stream of liquid is chilled in stages, air-treating means which is adapted to pass a stream of air in heat-exchange relationship with a liquid, a liquid distribution and return system which is operative to pass both of said streams of liquid to said air-treating means and thence back to said pumps, a liquid-to-air heat-exchange unit which is adpated to pass a stream of ambient air into heat-exchange relationship with a third stream of said liquid, a storage tank facility which is adapted to store a quantity of said liquid, and control means which is operative to pass portions of one or both of said first and second streams of liquid through said air-treating means or to pass other portions of said streams of liquid to said tank storage facility.

14. In an air conditioning system, the combination of, a plurality of air treating units in which air is subjected to the respective temperature changes to provide air to maintain acceptable conditions within a space, a water flow-line system, a pumping system to supply water at a controlled temperature to each of said units, a refrigeration system which acts as water heating means and water cooling means and which produces separate streams of heated water and chilled water, said pumping system being effective to circulate said streams of water to and through said units and to return the water from said units to said pumping system, said water supply line system comprising separate heated water and chilled water distribution lines and a separate neutral water supply line which is connected to the outlet of said pumping system and through which water is distributed without being subjected to either heating or cooling by said refrigeration system, and means to mix said neutral water with either said heated water or said chilled water as required to satisfy the temperature requirements of the water supplied to the respective of said units.

15. An air conditioning system as described in claim 14 wherein said pumping system comprises a heated water pump means and a chilled water pump means connected respectively to direct water with a preferential flow path through said water heating means and said water cooling means.

16. An air conditioning system as described in either of claims 14 or 15 wherein said neutral water supply line is connected to the upstream side of said water heating means and said water cooling means.

17. An air conditioning system as described in either of claims 14 or 15 wherein certain of said units supply conditioned air to interior spaces and other of said units supply conditioned air to exterior space, and wherein said water flow-line system includes lines extending respectively therefrom to said pumping system.

18. In an air-conditioning system, the combination of, a plurality of air treating units each of which is operative to subject a stream of air to heat-exchange relationship with a stream of air-treating water, a refrigeration system which is operative to produce separate streams of heated water and chilled water, pump means which is operative to circulate water along a flow circuit through said refrigeration means and thence to and from said air-treating units, and water-flow lines including separate lines for said heated water and said chilled water from said refrigeration system to said air-treating units and for return water from said air-treating units to said refrigeration means, said pump means being positioned upstream of said refrigeration means with respect to said refrigeration means, said water-flow lines including neutral water lines extending from said pump means to said air-treating units whereby the return water which passes through said pump means and does not pass through said refrigeration means is recirculated as said neutral water and is available at said air-treating means, and control means which includes means to control the temperature of the air passing through said air-treating units with a constant flow therethrough by mixing neutral water with either heated water or chilled water.

19. An air-conditioning system having a plurality of air-treating units each of which has an air-to-liquid heat-exchange unit and fan means to direct air through its unit in counter-flow relationship to water passing therethrough, refrigeration means which is operative to heat a first stream of water and to cool a second stream of water, separate water flow lines for each of said streams of water extending to each of said units, water return lines for returning said streams of water to said refrigeration means, water cooler means through which a portion of said first stream of water flows to discharge heat from said system, and pump means positioned downstream of said units and up-stream of said refrigeration means, said flow lines being adapted to direct water from said first stream to said water cooler after it has picked up heat in said units and said pump means, whereby the fan heat and pump heat is delivered to water forming said stream or said second stream of water before flowing to said refrigeration means.

20. An air-conditioning system having a plurality of air-treating units each of which has an air-to-liquid heat-exchange unit and fan means to direct air toward its unit in counter-flow relationship to water passing therethrough, refrigeration means which is operative to heat one stream of water thereby to provide a stream of heated water and to cool another stream of water thereby to provide a stream of cooled water, separate flow lines for said heated water and said cool water extending to said units and returning from said units to said refrigeration means, and pump means positioned downstream of said units and up-stream of said refrigeration means and connected to deliver water to said refrigeration means, said water flow lines comprising three separate supply lines two of which deliver said streams of heated water and cooled water to said units and a third line to deliver to said units a stream of neutral water which has returned from said units and which has not been subjected to either heating or cooling by said refrigeration means, and means to mix said neutral water with either said heated water or said cooled water when desired at said units.

* * * * *

UNITED STATES PATENT AND TRADEMARK OFFICE

CERTIFICATE OF CORRECTION

PATENT NO. : 4,419,864

DATED : December 13, 1983

INVENTOR(S) : Alden I. McFarlan

It is certified that error appears in the above-identified patent and that said Letters Patent is hereby corrected as shown below:

The term of this patent subsequent to November 8, 2000 has been disclaimed.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*